US006422956B1

(12) United States Patent
Kusmiss

(10) Patent No.: US 6,422,956 B1
(45) Date of Patent: Jul. 23, 2002

(54) APPARATUS FOR PRACTICING A BALL-PROPELLING SPORT USING A BALL-RETURNING DEVICE IN CONJUNCTION WITH AN IMAGING DEVICE

(76) Inventor: John H. Kusmiss, 11160 Langmuir Ave., Sunland, CA (US) 91040-2150

( * ) Notice: Subject to any disclaimer, the term of this patent is extended or adjusted under 35 U.S.C. 154(b) by 192 days.

(21) Appl. No.: 09/144,654

(22) Filed: Sep. 1, 1998

(51) Int. Cl.[7] ..... A63B 69/00
(52) U.S. Cl. ..... 473/435
(58) Field of Search ..... 473/435, 257

(56) References Cited

U.S. PATENT DOCUMENTS 1,558,762 A * 6/1925 Richter ..... 473/267
2,005,241 A * 6/1935 Robinson ..... 473/462
2,067,071 A * 1/1937 Browne ..... 473/465
2,939,224 A * 6/1960 Rose et al. ..... 434/257
3,180,643 A * 4/1965 Kallai ..... 473/435
3,215,432 A * 11/1965 Lee et al. ..... 473/462
3,456,945 A * 7/1969 Epply ..... 473/435
3,563,544 A * 2/1971 Hedrick ..... 473/435
3,692,307 A * 9/1972 Henry ..... 473/435
3,711,092 A * 1/1973 Hogue ..... 473/435
3,996,711 A * 12/1976 Pearson ..... 52/207
4,333,646 A * 6/1982 Pfeilsticker ..... 473/435
4,334,681 A * 6/1982 Scheie ..... 473/465
4,657,250 A * 4/1987 Newland et al. ..... 473/432
5,553,846 A * 9/1996 Frye et al. ..... 473/455
5,603,617 A * 2/1997 Light ..... 434/252
5,681,223 A * 10/1997 Weinreich ..... 472/61
5,797,805 A * 8/1998 Lubell et al. ..... 473/266

* cited by examiner

*Primary Examiner*—Paul T. Sewell
*Assistant Examiner*—M. Chambers

(57) ABSTRACT

The invention, which can be utilized by a player to practice his or her competence in any sport in which a ball is hit, thrown, kicked, or otherwise propelled, comprises a ball-returning device in conjunction with an imaging device disposed in relation to the ball-returning device such that a practicing player can observe his or her form while propelling balls against the backboard. In a first embodiment the invention comprises a substantially vertical backboard having as at least one portion thereof a mirror surface. The mirror surface may be part of the backboard which would normally return a ball hit against it or the mirror surface may be a portion of the backboard which is not normally hit by practice balls projected against the backboard. Lines of various sorts may be provided on the backboard surface to delimit desired areas of the backboard at which it is desirable to aim practice strokes. In one alternative embodiment, a see-through barrier (such as an elastic net or transparent plastic partition) serves as the ball-returning component of the device, with a mirror disposed in back of the barrier to reflect an image of the practicing player. In other alternate embodiments, a video camera and monitor are disposed in relation to the backboard or transparent barrier so as to allow the practicing player to see himself or herself while practicing.

12 Claims, 5 Drawing Sheets

APPARATUS FOR PRACTICING A BALL-PROPELLING SPORT USING A BALL-RETURNING DEVICE IN CONJUNCTION WITH AN IMAGING DEVICE

BACKGROUND OF THE INVENTION

The use of a wall, or any suitable substantially vertical surface, to hit tennis strokes against enables a player to practice by himself or herself. Such a surface used for practicing strokes is commonly referred to as a "backboard," and is used by tennis players all over the world to improve the form and consistency of their game. Usually lines are painted on the backboard to indicate the top and center strap of the net, that is, where the top and center strap would be if the backboard were actually a net on a tennis court. Most backboards are planar and nominally vertical structures, but variant designs can employ slanted, curved, or uneven surfaces so that the ball comes off at various angles or with various types of spin. Present-day backboards have been engineered to be much quieter than those of the past through the use of fiberglass and plastics such as Styrofoam. Although backboards have in the main been used for practicing tennis, with suitable modifications they could be employed for any sport involving the propulsion by the player of the ball or other projectile used in the sport. Some obvious examples include handball and racquetball.

Two of the advantages of practicing against a backboard are that (1) it can be done without a partner, and (2) every ball hit against the backboard is invariably returned. Research has found that backboard practice contributes to the acquisition of motor skills and the ability to respond automatically. Backboard practice teaches concentration and control of the ball while providing physical conditioning. A practice backboard is the equivalent of a partner who never gets tired. Further advantages include being able to hit a much larger number of strokes per unit time than in a match or practice session on a court, and the fact that the backboard returns the ball more quickly than a live partner would, forcing the backboard practicer to adopt good racket preparation habits.

In the past, tennis backboards were a familiar feature of public parks and schoolyards. Many a player who could not afford to belong to a tennis club or country club was able to practice while waiting for a public court or in the absence of a playing partner. One survey of touring tennis professionals indicated that three out of four of them credit backboards for honing their strokes. Indeed, tennis champions Martina Navratilova and Ivan Lendl have been quoted as saying that practice backboards were the chief vehicles for their learning the game. The majority of tennis players in the world still use public facilities to engage in the sport.

The major disadvantage is that it is very easy for players who are not expert to fall into bad habits of form while practicing against a backboard and to wind up practicing strokes which are improperly produced. The bad habits which can be fallen into include poor racket preparation, poor footwork, improper backswings and/or follow-throughs, and so forth. There has been a long-felt need for a practice backboard which the practicing player can use to improve his or her strokes, rather than fall into bad habits in the production thereof, by being able to observe himself or herself while practicing.

The following U.S. patent describe various sports practice devices or apparatuses which may be related to the present invention.

U.S. Pat. No. 1,410,811 to A. H. H. Lewis is directed to a self-instructor for games, comprising a mirror, a picture of a figure having an ideal pose, means for supporting the picture adjacent the mirror and in such a relationship thereto that the image of the observer in the mirror is closely adjacent the pictured figure, the observer's image and the pictured figure being simultaneously visible to the observer when standing in front of the mirror, and indicating means on the mirror and picture of aiding the observer in positioning himself so that his image is similar to the figure illustrated.

U.S. Pat. No. 1,510,402 to W. Hopwood is directed to an appliance for playing games resembling lawn tennis, comprising a frame, the bottom portion of which may be made of string net, with the upper portion made of a material which will cause a ball projected against it to rebound, and one or more gaps or pockets immediately above the lower portion of the frame through or into which a ball can be projected. In practice, the placing of the ball through the gap or gaps with the aid of a tennis racket on a court resembling a tennis court but of small dimensions may count as a proper service, whereas if the ball misses the gap, it is played on the rebound until it is either projected against the lower portion of the frame or goes out of bounds on the rebound, when a score against the player is recorded. If two players are playing simultaneously then they hit the ball alternately.

U.S. Pat. No. 1,558,762 to B. Richter is directed to an instruction device comprising a mirror that may be placed in front of a performer in such a position that he can readily see his image, and in juxtaposition with the mirror pictures are arranged showing the correct postures for successive movements. When the device is used as a golf instructor, for example, the pictures will illustrate the back-stroke and the follow-through for each stroke commonly used.

U.S. Pat. No. 2,005,241 to C. I. Robinson is directed to a game practice means whereby the rebound of a ball from a vertical surface against which it is projected will be indicated thereon or on a horizontal fore field or foreground so that the player can determine whether the ball would have alighted within predetermined boundaries had its flight been uninterrupted by the vertical surface. When employed for practicing tennis, the practice means enables the player to practice from service positions, fixed volley positions, and catch-as-can positions governed by the rebound of the ball when projected against a vertical ball returning member.

U.S. Pat. No. 2,067,071 to M. K. Browne is directed to a battle board tennis game for which the equipment comprises a back board, a bottom board disposed in angular relationship to with the back board to deliver the return ball over a net, and a net that is preferably supported by arms and that is spaced from the bottom board. Floor markings comprise boundary side lines continuous with an end boundary base line, a pair of transverse lines that together with the boundary side lines define the boundaries of the service courts into which the ball returned from a serve must strike, and which are divided into right and left service courts by a middle line, and service box lines from which the ball may be served against the board.

U.S. Pat. No. 2,992,002 to H. Bingham, Jr. is directed to a recreational rebound net comprising a recreational enclosure constructed on the sides and top of wire or a wire-like material, the enclosure being supported by a substantially flat base or floor, and there being included within the enclosure a resilient means for absorbing, slowing down, dampening, deflecting, bouncing, or otherwise acting against the force of the ball which is used by the player or players within the enclosure.

U.S. Pat. No. 3,110,495 to S. T. Carter is directed to a mirror system for golf analysis comprising a mirror located near a golf tee, with both mirror and tee being located within the normal range of vision of a golfer in position to hit a ball from the tee, and means for reflecting an image of the golfer onto the mirror, the mirror being so arranged that the entire image is visible to the golfer so that he or she can study his or her position and movements while addressing and actually hitting the ball.

U.S. Pat. No. 3,180,643 to O. Kallai is directed to a tennis training apparatus which includes an adjustable ball returning surface and a net for catching balls which do not strike the ball returning surface.

U.S. Pat. No. 3,215,432 to R. H. Lee et al. is directed to a tennis serve practice device comprising a flexible sheet arranged vertically with respect to a flat practice area to form a ball stop. The device is also provided with a target area or opening above a net height indicator on the sheet, and to one side of a center line indicator. In the use of the device, a tennis service area is accurately positioned in front of the sheet in a predetermined position with respect to the target opening so that a player serving a ball from the service area through the target opening will know that his "serve" would have been correctly positioned had he actually been playing a game of tennis.

U.S. Pat. No. 3,456,945 to W. R. Epply is directed to a folding portable sports screen comprising a rectangular frame formed, for example, by six metal L-beam members joined for supporting a web such as a rebound net against which tennis balls and the like may be bounced. When the screen is folded for storage or transporting, the net is housed in a rectangular channel formed by the six L-beam members.

U.S. Pat. No. 3,563,544 to Andrew J. Hedwick is directed to a portable tennis instruction and practice apparatus having a large, vertically disposed rectangular board with vertically disposed, rectangularly shaped nets located along the upper and lower edges thereof, and extending above and below the respective edges thereof. The board is held in an upright position by pivotally attached column support members.

U.S. Pat. No. 3,692,307 to Francis B. Henry is directed to a live action backboard which is constructed of materials and is so designed as to give the practicing player the impression of actually facing a competitor who appears on the surface of the backboard. The backboard is in part constructed of pictorial parallax panoramagram units which depict in depth one or more tennis players in various position. The units are designed so that the depicted players appear to move when the practicing player changes position with respect to the backboard.

U.S. Pat. No. 3,697,068 to Julia P. McDougall is directed to a nonplanar ball rebound wall for practicing tennis or similar games. The structure provides a rebound surface which is nonplanar so that rebound characteristics are obtained which differ from those of a conventional flat practice wall. In particular, the rebound surface defines a generally concave configuration coupled with indented or projecting formations so that generally a ball rebounds towards a center line of the wall but an unexpected bounce is obtained when the ball strikes a formation.

U.S. Pat. No. 4,333,646 to Pfeilsticker is directed to equipment of the backboard type which incorporates an upright, panel-like structure located at one end of a surface which preferably is lined to simulate half of a tennis court of standard dimensions. The backboard is provided with a reflective surface which extends over the full width and height thereof, whereby the player sees his reflected image, with the image appearing at the opposite side of, and being seen through the interstices of, a net simulation incorporated in the reflectively surfaced area.

BRIEF SUMMARY OF THE INVENTION

The invention comprises a substantially vertical backboard with at least a portion thereof which is a mirror surface that allows a practicing player to observe his or her form while hitting balls against the backboard. The mirror surface may be part of the backboard which would normally return a ball hit against it or the mirror surface may be a portion of the backboard which is not normally hit by practice balls projected against the backboard. If the mirror portion is a planar surface, the plane of the mirror portion may be inclined with respect to the nominally planar surface of the rest of the backboard. Lines of various sorts may be provided on the backboard surface to delimit desired areas of the backboard at which it is desirable to aim practice strokes. In one alternative embodiment, a see-through barrier (such as an elastic net or nonelastic transparent plastic partition) serves as the ball-returning component of the device, with a mirror disposed in back of the barrier to reflect an image of the practicing player. In other alternate embodiments, a video camera and monitor are disposed in relation to the backboard or transparent barrier so as to allow the practicing player to see himself or herself while practicing.

DETAILED DESCRIPTION

The present invention encompasses any device which allows a player to practice or improve his or her ability to play any sport which can be practiced by hitting, throwing, kicking, or otherwise propelling a ball against a vertical surface or elastic net which returns the ball to the player. Examples include tennis, squash, handball, racket ball, paddle tennis, table tennis, and soccer. I shall hereinafter refer to the sport of lawn tennis, although it should be clear that other sports can be practiced in the same or in a similar manner.

The present invention provides a backboard that provides an image of the practicing player so that the player can see himself or herself while practicing. Of course, the player must have some idea of proper stroke production to begin with, but given that, the advantage of being able to watch oneself in real time while practicing is enormous. Tennis professionals recognize the value of their students' being able to see themselves by utilizing video cameras and playback monitors, but of course there is a time delay inherent in such a set-up. The present invention is a cheaper alternative that allows a player to practice alone and observe his or her form in real time.

Tennis players commonly hit balls against a wall or any other suitable vertical surface for the purpose of improving their tennis game, in particular their strokes such as the service, forehand and backhand drives, and forehand and backhand volleys. The present invention combines the use of a practice rebounding surface or net with an imaging device which enables the practicing player to see his or her own image while practicing. In its simplest form the imaging device would comprise a plane mirror surface or surfaces arranged in such a manner as to give the practicing player a view of his or her self while the player hits balls against the ball-returning component.

Figure 1:
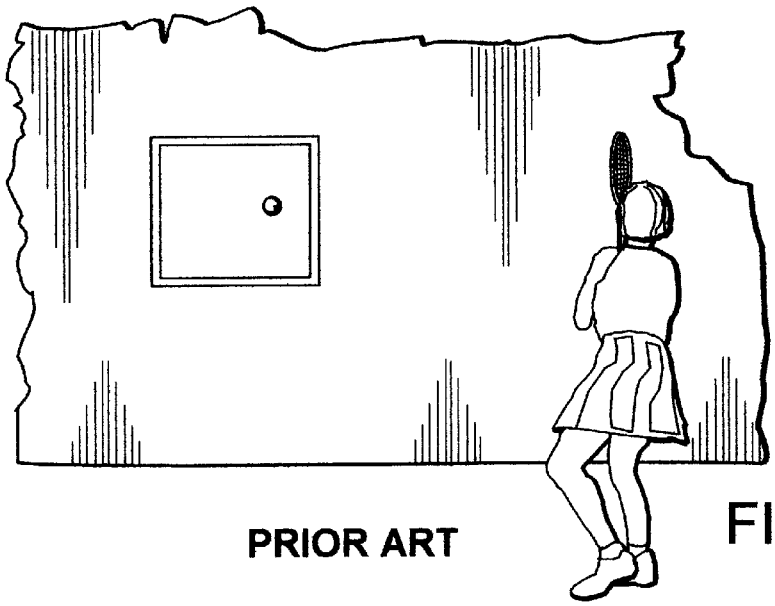
PRIOR ART FIG. 1
FIG. 1 depicts a tennis player hitting a tennis ball against a conventional backboard including a net stripe and target square above the net.

Referring to FIG. 1, a tennis player can be seen hitting a tennis ball against a conventional vertical tennis backboard on which a horizontal stripe represents the top of a tennis court net and a square outline represents some sort of target area that the player can aim at.

Figure 2:
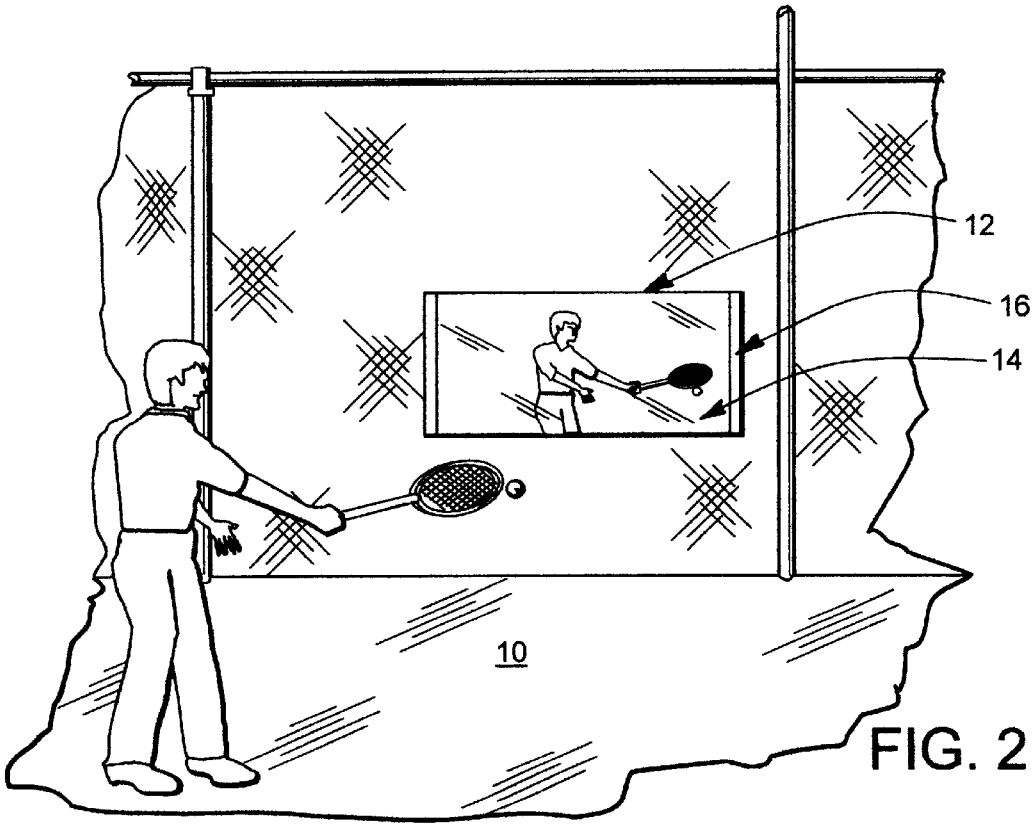
FIG. 2 depicts a tennis player hitting a tennis ball against one embodiment of the present invention.

Referring to FIG. 2, a tennis player can be seen hitting a tennis ball against one embodiment 10 of the present invention comprising a substantially planar mirror backboard 12 mounted substantially vertically on a fence surrounding a tennis court. The player has just hit a practice forehand stroke, and the ball can be seen just before it strikes the mirror backboard 12. An image of the player which the player can see is shown. Mirror backboard 12 comprises a thin, clear mirror-backed plastic sheet 14 glued on a wooden panel 16. Holes have been drilled through wooden backing 16 through which heavy flexible metal wires attach the backboard to the fence.

The transparent plastic polymethyl methacrylate is available commercially in large sheets with a mirror backing. Other types of transparent plastic, particularly those which are more scratch-resistant, can be used for the mirror portion of the backboard. A conventional glass mirror might be used instead if it were mounted with some sort of cushioning layer behind it to absorb the shock of tennis balls hit against the mirror. The glass employed in making the mirror would have to be a tempered variety to withstand the shock of tennis ball impacts without cracking or shattering.

Figure 3:
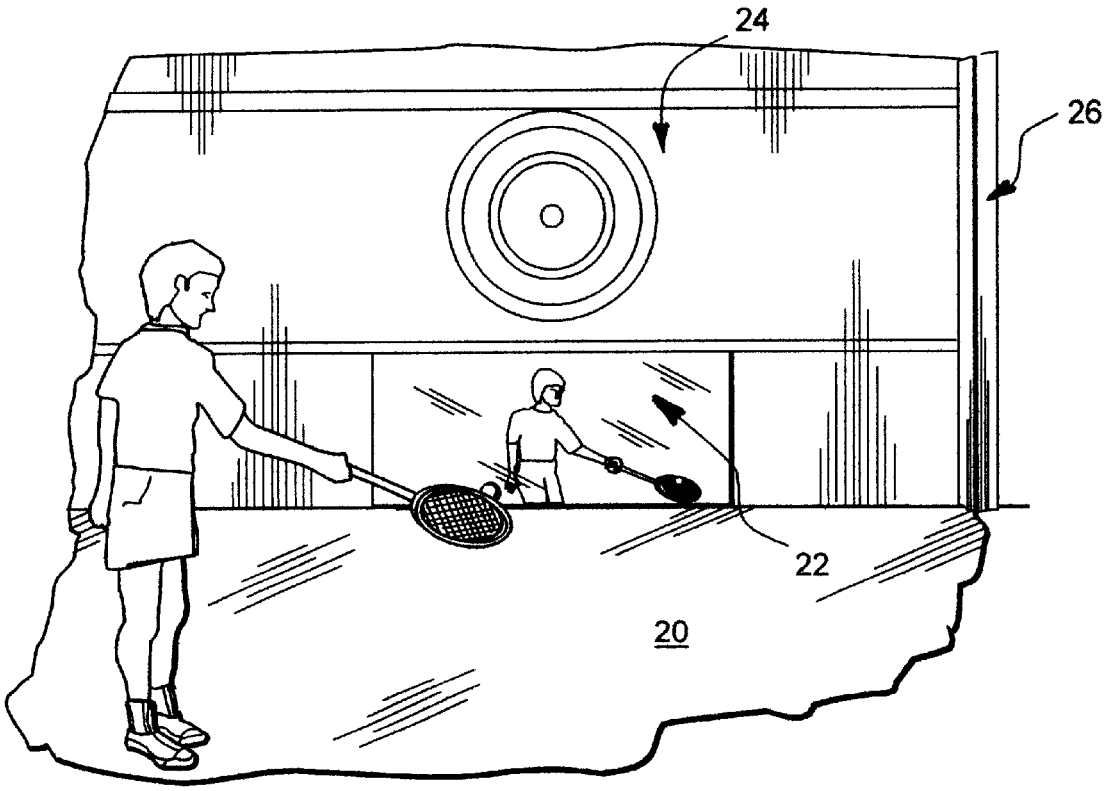
FIG. 3 depicts a tennis player hitting a tennis ball against another embodiment of the present invention.
Figure 9:
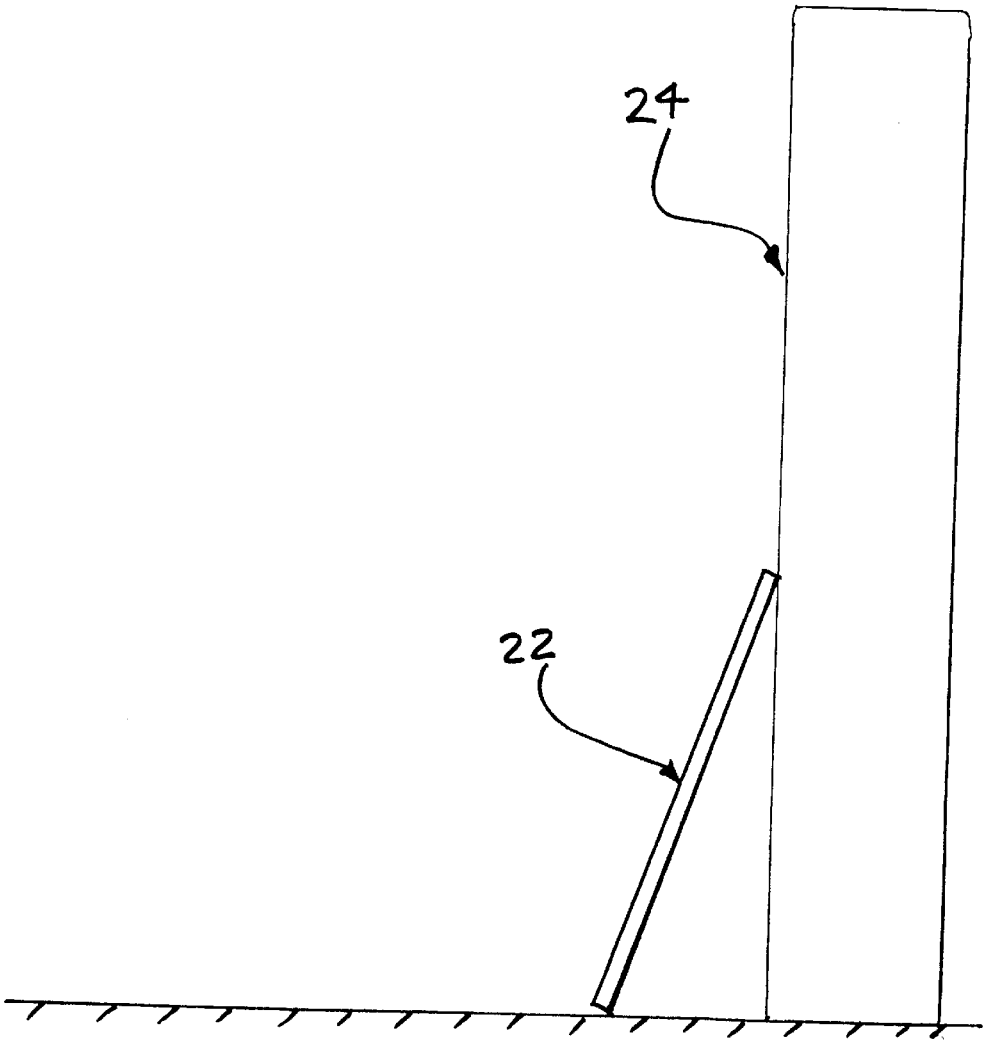
FIG. 9 is a schematic side view of the embodiment of the invention shown in FIG. 3.

However, as can be seen from FIG. 3, the mirror portion of the backboard need not be a part of the backboard that is normally hit by tennis balls. In the embodiment 20 shown, the mirror portion 22 is mounted below the target area 24 of the backboard 26 and is only hit by misdirected or mishit ground strokes of the practicing player. The mirror portion 22 of the practice backboard 26 can be tilted away from the practicing player by a small angle from the vertical to give the practicing player a better view of him- or herself, as show in FIG. 9.

Figure 4:
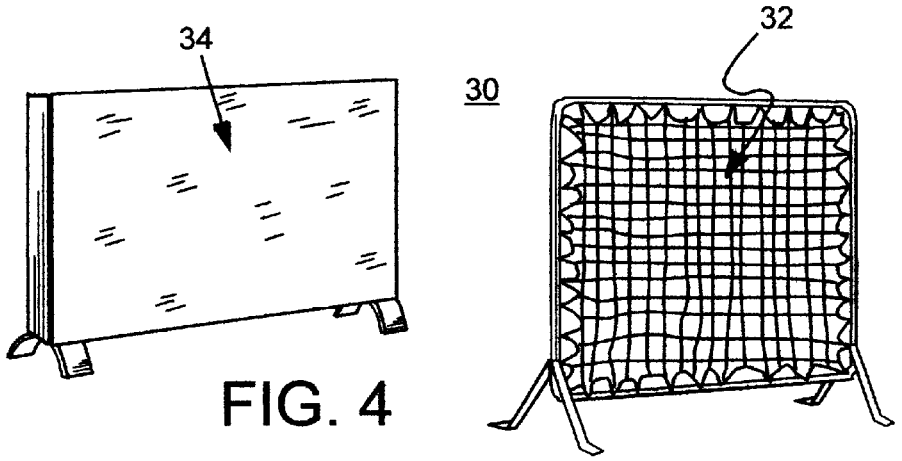
FIG. 4 is a perspective drawing of an embodiment of the present invention employing a see-through barrier comprising an elastic net in front of a backboard with a mirror surface.

FIG. 4 depicts another embodiment 30 of the invention in which a see-through barrier, in this case an elastic mesh or net 32, is disposed between the practicing player and a mirror surface 34. The advantage of this arrangement is that scratches on the mirror surface 34 from impacts of tennis balls are avoided, since the elastic net or mesh 32 serves to return the tennis balls hit against it to the practicing player.

Figure 5:
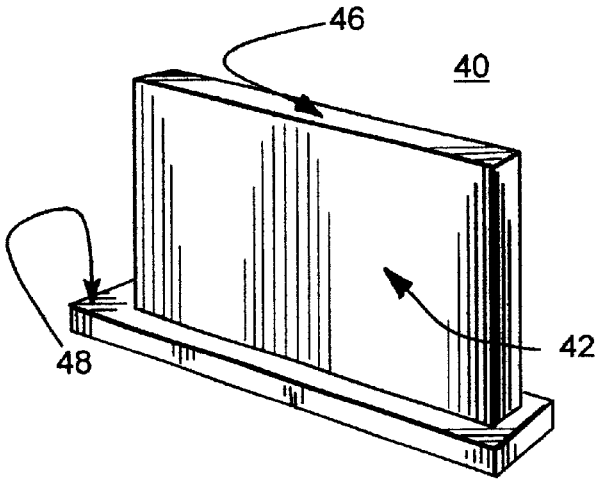
FIG. 5 is a perspective drawing of an embodiment of the present invention employing a see-through barrier comprising a transparent plastic partition in front of a backboard with a mirror surface.
Figure 5:
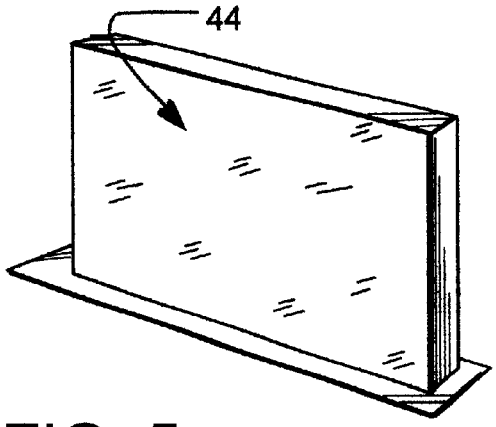

FIG. 5 depicts another embodiment 40 of the invention in which a see-through barrier, in this case a transparent plastic partition 42, is disposed between the practicing player and a mirror surface 44. The advantage of this arrangement is that scratches on the mirror surface 44 from impacts of tennis balls are avoided, since the transparent plastic partition 42 serves to return the tennis balls hit against it to the practicing player. Plastic partition 42 can be made from a shatter-proof plastic with a highly scratch-resistant surface, while at the same time the mirror surface 44 can be a high-quality glass mirror, protected as it is from any strong impact by a tennis ball hit directly against it. Transparent barrier 42 can be constructed, for example, by using a sheet of transparent plastic 46 fixed in some sort of a wooden frame or support 48.

Figure 6:
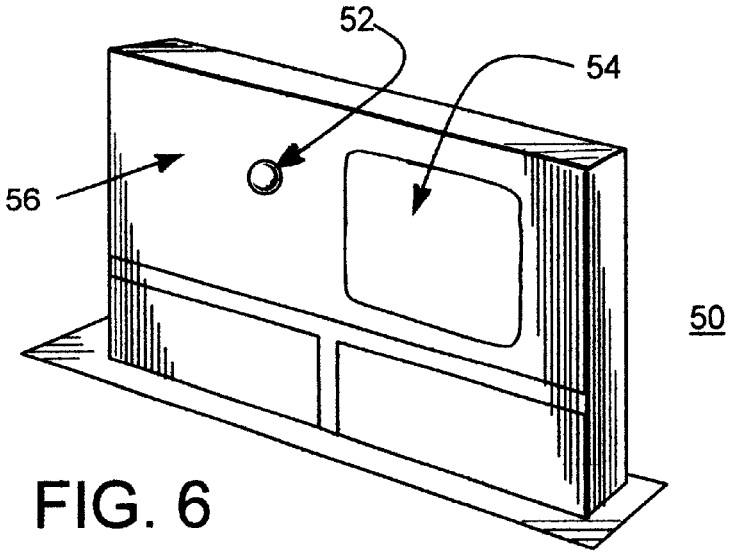
FIG. 6 is a perspective drawing of an embodiment of the present invention employing a backboard with a video camera and monitor forming part of the backboard structure to serve as the imaging device.

FIG. 6 shows another embodiment 50 of the invention in which a video camera 52 and a large video monitor 54 are mounted in a tennis practice backboard 56. The lens of video camera 52 is aimed toward the practicing player and its video output is fed to video monitor 54 so that the practicing player can see him- or herself in the large monitor while practicing. Camera 52 and monitor 54 are mounted in such a way as to prevent damage to them from tennis balls hit against backboard 56. For example, the face of monitor 54 can be protected by a transparent, impact-resistant plastic shield mounted in front of it. Video cameras currently available include units with such a small-diameter lens that they could be mounted behind the backboard to view the player through a small hole through which a tennis ball could not penetrate.

Figure 7:
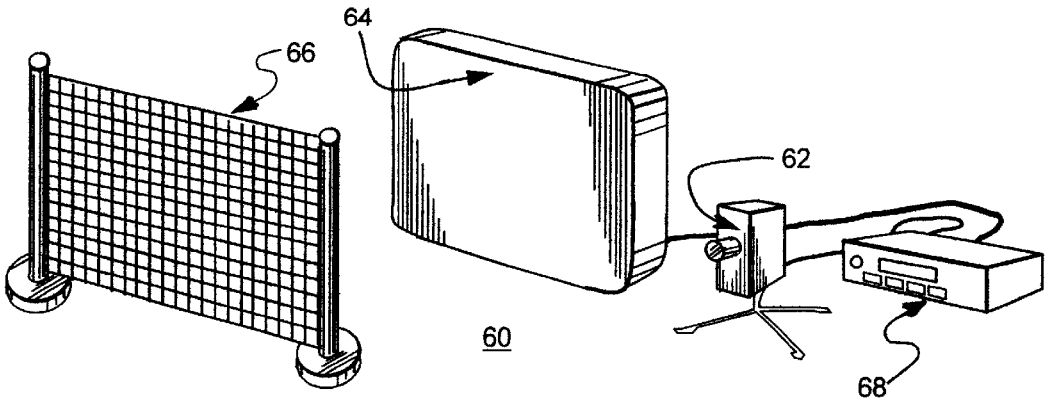
FIG. 7 is a perspective drawing of an embodiment of the present invention employing an elastic net in front of a video camera and monitor serving as the imaging device.
Figure 8:
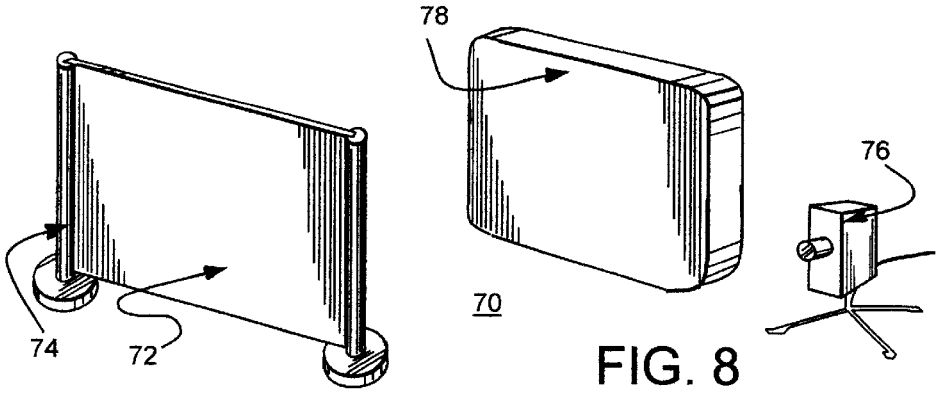
FIG. 8 is a perspective drawing of an embodiment of the present invention employing a transparent backboard with a video camera and monitor serving as the imaging device.

FIG. 7 depicts another embodiment 60 of the invention in which a video camera 62 and a large video monitor 64 are placed behind an elastic net 66 which returns balls hit against it. A video recorder 68 can be connected to camera 62 for recording images of the practicing player for intermittent or later viewing. In another embodiment 70 the ball-returning device is a transparent backboard 72 mounted in some sort of supporting frame 74, with a video camera 76 and large video monitor 78 serving as the imaging device, as shown in FIG. 8.

There is a large variety of commercially available video cameras, recorders, and monitors available and the mechanics of their interconnection and functional setup is well known in the art.

It should be understood that the invention it its broader aspects is not limited to the specific embodiments shown and described herein, but departures may be made therefrom within the scope of the appended claims without departing from the principles of the invention and without sacrificing its chief advantages. All such modifications and changes will make themselves apparent to those of ordinary skill in the art and all such changes and modifications are intended to be covered by the following claims.

What I claim is:

1. An apparatus to enable a player of a sport involving the propulsion of a ball or the like to practice said sport, comprising:

a ball-returning device for returning balls hit against it, and an imaging device separate and spaced apart from said ball-returning device and disposed in relation to said ball-returning device so as to allow said player to observe his or her form while hitting said balls, wherein said ball-returning device includes a transparent backboard and said imaging device includes a mirror disposed in back of said backboard.

2. The apparatus of claim 1 further comprising lines on said transparent backboard to delimit areas at which it is desirable to aim a ball while practicing.

3. An apparatus to enable a player of a sport involving the propulsion of a ball or the like to practice said sport, comprising:

a ball-returning device for returning balls hit against it, and an imaging device disposed in relation to said ball-returning device so as to allow said player to observe his or her form while hitting said balls, wherein said ball-returning device includes an elastic net and said imaging device includes a mirror disposed in back of said elastic net.

4. An apparatus to enable a player of a sport involving the propulsion of a ball or the like to practice said sport, comprising:

a practice backboard for returning balls hit against said backboard, and imaging means disposed in relation to said ball-returning means for allowing said player to observe his or her form while hitting said balls, wherein said imaging means includes a video camera aimed at said player in combination with a video monitor mounted in said backboard within the field of view of said player and operatively connected to said camera.

5. The apparatus of claim 4 further comprising a video-tape recorder operatively connected to said camera for recording images of said player practicing with said apparatus, whereby said player can view said images while resting between practice sessions.

6. The apparatus of claim 4 in which said practice backboard comprises a conventional practice backboard consisting of a purely passive structure whose larger mass in combination with an elasticity of said ball enables balls hit against it to be returned to said player.

7. The apparatus of claim 6 further comprising lines on said conventional practice backboard to delimit areas at which it is desirable to aim a ball while practicing.

8. The apparatus of claim 4 in which said practice backboard comprises a transparent backboard.

9. The apparatus of claim 8 further comprising lines on said transparent backboard to delimit areas at which it is desirable to aim a ball while practicing.

10. The apparatus of claim 9 wherein said transparent backboard comprises a solid plastic partition.

11. The apparatus of claim 4 in which said practice backboard comprises an elastic net.

12. An apparatus to enable a player of a sport involving the propulsion of a ball or the like to practice said sport, comprising:

ball-returning means for returning balls hit against said means, and imaging means disposed in relation to said ball-returning means for allowing said player to observe his or her form while hitting said balls, wherein said ball-returning means includes a substantially vertical backboard having an upper part for aiming balls against and a flat lower part which is a mirror, said lower part being tilted from the vertical such that a perpendicular to the surface of said flat lower part deviates from the horizontal to a degree which allows said player to hit balls against said upper part while allowing said player to simultaneously observe his or her form in said mirror when said player is located a suitable practicing distance from said backboard.

* * * * *